US010214987B2

(12) United States Patent
Varghese et al.

(10) Patent No.: US 10,214,987 B2
(45) Date of Patent: Feb. 26, 2019

(54) DOWNHOLE TOOL WITH INTEGRATED SCALE REMOVAL FEATURE

(71) Applicants: Sibu Varghese, Pensacola, FL (US); Russell Kurtis Fleetwood, Katy, TX (US); Sathish Kalaimani, Chennai (IN)

(72) Inventors: Sibu Varghese, Pensacola, FL (US); Russell Kurtis Fleetwood, Katy, TX (US); Sathish Kalaimani, Chennai (IN)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 148 days.

(21) Appl. No.: 15/252,839

(22) Filed: Aug. 31, 2016

(65) Prior Publication Data

US 2018/0058172 A1 Mar. 1, 2018

(51) Int. Cl.
*E21B 33/12* (2006.01)
*E21B 37/02* (2006.01)

(52) U.S. Cl.
CPC ..... *E21B 33/12* (2013.01); *E21B 37/02* (2013.01)

(58) Field of Classification Search
CPC ..... E21B 37/02; E21B 33/12; E21B 33/128; E21B 33/129; E21B 33/1291; E21B 23/06
See application file for complete search history.

(56) References Cited

U.S. PATENT DOCUMENTS 9,657,546 B2 * 5/2017 Williams ..... E21B 33/1208
9,732,580 B2 * 8/2017 Krueger ..... E21B 33/1208
9,810,037 B2 * 11/2017 Reinhardt ..... E21B 33/1208
9,920,588 B2 * 3/2018 Turley ..... E21B 33/128
2003/0193145 A1 * 10/2003 Reimert ..... E21B 33/035 277/336
2004/0226724 A1 * 11/2004 Hirth ..... E21B 33/12 166/387
2008/0296844 A1 * 12/2008 Doane ..... E21B 33/1208 277/336
2009/0139709 A1 * 6/2009 Doane ..... E21B 23/01 166/138
2010/0326675 A1 * 12/2010 Doane ..... E21B 33/1216 166/387
2012/0090858 A1 * 4/2012 Ingram ..... E21B 23/06 166/387
2012/0205873 A1 * 8/2012 Turley ..... E21B 33/1216 277/336
2014/0332239 A1 * 11/2014 Porta ..... E21B 33/1285 166/387
2015/0330175 A1 * 11/2015 Williams ..... E21B 33/1208 166/118
2015/0337618 A1 * 11/2015 Hern ..... E21B 33/1208 166/376
2016/0032680 A1 * 2/2016 Krueger ..... E21B 33/1208 166/191

(Continued)

OTHER PUBLICATIONS

Crabtree, et al.; "Fighting Scale-Removal and Prevention"; Oilfield Review, Autumn 1999; 16 pages.

(Continued)

*Primary Examiner* — Jennifer H Gay
(74) *Attorney, Agent, or Firm* — Cantor Colburn LLP

(57) ABSTRACT

A downhole tool including a settable member, a scale removal feature depending from the settable member, the scale removal feature including a protrusion extending radially inwardly from an inside dimension of the settable member.

8 Claims, 2 Drawing Sheets

(56) References Cited

U.S. PATENT DOCUMENTS

| | | | | |
|---|---|---|---|---|
| 2016/0097255 | A1* | 4/2016 | Doane | E21B 33/1285 166/308.1 |
| 2016/0258244 | A1* | 9/2016 | Connelly | E21B 33/1208 |
| 2016/0326831 | A1* | 11/2016 | Reinhardt | E21B 33/1285 |
| 2017/0191342 | A1* | 7/2017 | Turley | E21B 33/128 |
| 2018/0058172 | A1* | 3/2018 | Varghese | E21B 37/02 |

OTHER PUBLICATIONS

Lea, et al.; "What's new in Artifical Lift"; World Oil, May 2006 issue, pp. 75-86, 3 pages total.

* cited by examiner

DOWNHOLE TOOL WITH INTEGRATED SCALE REMOVAL FEATURE

BACKGROUND

Many tools in the resource recovery industry require setting by expansion. Such tools may include seals for example although other radially expandable tools are also used. In some cases relative movement of a cone is required. Problems can occur with such devices, especially where seals are concerned but broadly even due to frictional increases beyond expectation, with sand or scale depositions on the cone. The art would well receive reliable constructions that improve functionality.

SUMMARY

A downhole tool including a settable member, a scale removal feature depending from the settable member, the scale removal feature including a protrusion extending radially inwardly from an inside dimension of the settable member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
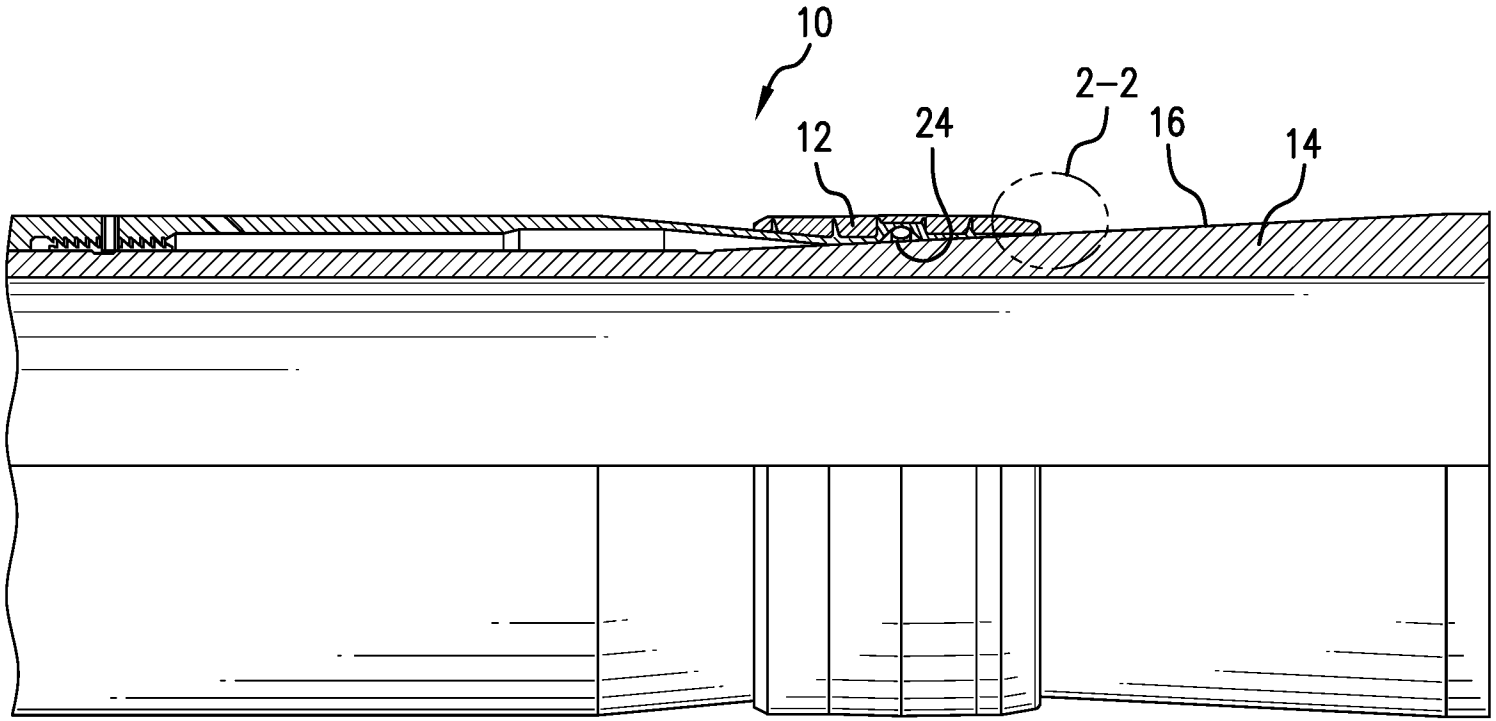
FIG. 1 depicts a schematic cross sectional representation of an embodiment of a seal and cone embodiment with the integrated scale remover as disclosed herein.

Referring to FIG. 1, a downhole tool 10 configured as a settable member 12 (shown for example as a seal in FIG. 1) and cone 14 is illustrated. During use, the settable member 12 and cone 14 are positionally adjusted to cause the seal to expand radially outwardly. During this movement the settable member 12 traverses a surface 16 of the cone 14. This is where there can be a problem if indeed scale, sand or other accumulated debris resides on surface 16. Such debris can impede movement of the settable member 12 on the cone 14 making setting more difficult or impossible and where the settable member 12 is a seal, the existence of such debris may reduce the ultimate differential pressure sustaining properties of the seal due to such debris either becoming lodged between the seal and the cone 14 or due to the debris scoring the surface 16 of the cone prior to the seal 12 sealing thereto hence leaving leak paths at an interface of the seal 12 and the cone surface 16.

As disclosed herein the settable member 12 is a metal backed resilient member (such as a packer) and is constructed with an integrated scale removal feature 18 depending therefrom. In some embodiments the feature 18 provides a cantilever 21 and in some embodiments the feature comprises metal material.

Figure 2:
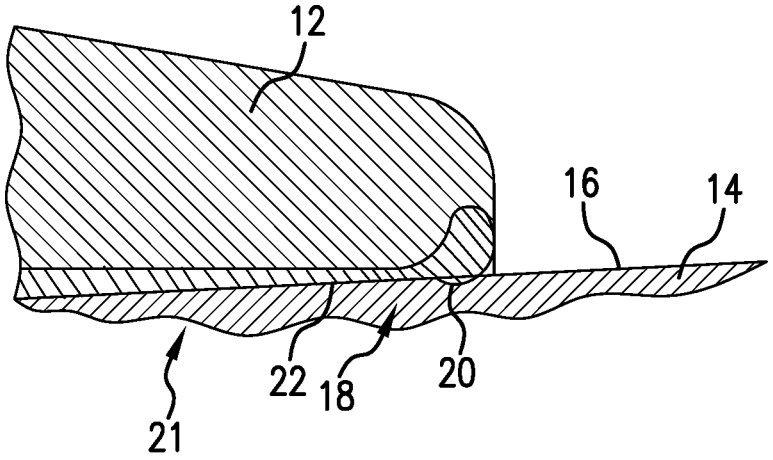
FIG. 2 depicts an enlarged view of circumscribed area 2-2 in FIG. 1.

Referring to FIG. 2, it can be appreciated that the feature 18 includes a cantilever 21 that extends radially inwardly of a surface 22 representing an inside dimension of the settable member 12. In embodiments, the protuberance 20 extends radially inwardly from surface 22 by 0.050 or less and in an embodiment by 0.001 to 0.050 inch. The protuberance 20 when the settable member 12 is positioned on the surface 16 is forced to deflect along the feature 18 resulting in the protuberance 20 being forcibly biased into contact with the surface 16 by the resilience of the material of the feature itself and the material of the settable member 12. The forcible contact generated is sufficient to remove scale from the cone 14 as the settable member 12 moves relative to the cone surface 16.

The feature 18 significantly improves sealing competency and reliability by ensuring scale and sand that invariably accumulates on surface 16 during running or other activity is excluded from any area under the settable member 12 thereby ensuring an unimpeded contact between the settable member 12 and the cone 14. As illustrated, in some embodiments, the settable member includes an o-ring 24. The feature 18 ensures no sand will interfere with the o-ring 24.

Due to the prominence of the protuberance and the resilience produced by the settable member 12, the feature 18 automatically handles its function upon movement of the settable member 12 versus the cone 14.

Set forth below are some embodiments of the foregoing disclosure:

Embodiment 1

A downhole tool including a settable member, a scale removal feature depending from the settable member, the scale removal feature including a protrusion extending radially inwardly from an inside dimension of the settable member.

Embodiment 2

The downhole tool as in the prior embodiment wherein the settable member is a metal backed resilient seal.

Embodiment 3

The downhole tool as in any prior embodiment wherein the settable member is a packer.

Embodiment 4

The downhole tool as in any prior embodiment wherein the scale removal feature includes a cantilever.

Embodiment 5

The downhole tool as in any prior embodiment wherein the protrusion depends from the cantilever.

Embodiment 6

The downhole tool as in any prior embodiment wherein the protrusion extends radially inwardly from the inside dimension of the settable member by 0.001 inches or more.

Embodiment 7

The downhole tool as in any prior embodiment wherein the protrusion extends radially inwardly from the inside dimension of the settable member by 0.050 inches or less.

Embodiment 8

The downhole tool as in any prior embodiment wherein the feature is metal.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a cone;

a settable member having a conical inside dimension surface that during use is in contact with a surface of the cone, the inside dimension surface defining a cone interface plane;

a scale removal feature depending from the settable member, the scale removal feature including:

a radially deflectable protrusion extending radially inwardly from the inside dimension surface of the settable member beyond the interface plane and biased into contact with the surface of the cone during use.

2. The downhole tool as claimed in claim 1 wherein the settable member is a metal backed resilient seal.

3. The downhole tool as claimed in claim 1 wherein the settable member is a packer.

4. The downhole tool as claimed in claim 1 wherein the scale removal feature includes a cantilever.

5. The downhole tool as claimed in claim 4 wherein the protrusion depends from the cantilever.

6. The downhole tool as claimed in claim 1 wherein the protrusion extends radially inwardly from the inside dimension of the settable member by 0.001 inches to 0.050 inches.

7. The downhole tool as claimed in claim 1 wherein the protrusion extends radially inwardly from the inside dimension of the settable member by 0.050 inches or less.

8. The downhole tool as claimed in claim 1 wherein the feature is metal.

* * * * *